US007836525B2

(12) United States Patent
Castillo et al.

(10) Patent No.: US 7,836,525 B2
(45) Date of Patent: Nov. 23, 2010

(54) COMFORT SEAT AND COMMODE DEVICE FOR A WHEEL CHAIR AND THE LIKE

(76) Inventors: Hector Castillo, 176 Cranford Blvd., Mastic, NY (US) 11950; Mahendra C. Shah, 8 Julia La., East Northport, NY (US) 11731

( * ) Notice: Subject to any disclaimer, the term of this patent is extended or adjusted under 35 U.S.C. 154(b) by 119 days.

(21) Appl. No.: 12/218,763

(22) Filed: Jul. 17, 2008

(65) Prior Publication Data

US 2010/0011496 A1 Jan. 21, 2010

(51) Int. Cl.
*A47K 11/04* (2006.01)

(52) U.S. Cl. ..... 4/476; 4/478; 4/480; 5/604

(58) Field of Classification Search ..... 4/450, 4/480, 476, 478; 5/604
See application file for complete search history.

(56) References Cited

U.S. PATENT DOCUMENTS 557,614 A * 4/1896 Schmitt ..... 5/604
818,821 A * 4/1906 Feely ..... 4/480
2,384,325 A * 9/1945 Marsan ..... 5/604
3,345,652 A * 10/1967 Hiraga ..... 5/604
4,571,759 A * 2/1986 Sasaki et al. ..... 5/604
5,123,126 A 6/1992 Vincent
5,197,152 A 3/1993 Rose et al.
5,351,349 A * 10/1994 Tsai et al. ..... 5/604
5,577,753 A 11/1996 Pociask
6,450,518 B1 9/2002 Howard

* cited by examiner

*Primary Examiner*—Robert M Fetsuga
(74) *Attorney, Agent, or Firm*—Thomas A. O'Rourke; Bodner & O'Rourke, LLP

(57) ABSTRACT

A Comfort Seat and Commode Device that is adaptable for incorporation into a wheel chair, an ordinary arm chair or couch or bed, a hospital bed, or any other means of convalescence or permanent occupation by the disabled, is herein disclosed. The device's framework supports a seat portion that is capable of rotating to provide an opening through which a patient or disabled person may eliminate waste. The rotatable seat is located in-line vertically with a waste bin and cover that comprise the commode. An actuation means is provided, which, in response to a command by the user, simultaneously opens the waste bin cover, rotates the seat, and elevates the waste bin to permit use of the device. A means of providing squirting action of a cleaning solution to cleanse the user after elimination, as well as a drying system, may also be incorporated into the device.

21 Claims, 13 Drawing Sheets

COMFORT SEAT AND COMMODE DEVICE FOR A WHEEL CHAIR AND THE LIKE

FIELD OF THE INVENTION

This invention relates to an adaptable means of providing toilet access for non-ambulatory persons, and more particularly to such means which may be integrally incorporated into the apparatus or furnishing normally occupied by such persons.

BACKGROUND OF THE INVENTION

As greater numbers of baby boomers have transitioned to retirement and begun to anticipate and experience the decline in vitality and health associated with the aging process, increasing consideration has been given to issues relating to the end of life years. Some of this attention has focused on the means of caring for those who have simply become infirm, or have become an invalid as a result of illness. This attention has in part also been due to media exposure surrounding public officials and celebrities who have permitted disclosure of such information, including those who are handicapped and no longer ambulatory as a result of disease or accidents.

The major care-giving issues typically include general and oral hygiene, basic physical exercise to prevent atrophy or even a full physical therapy program if appropriate, proper feeding to satisfy nutritional requirements of the injured or elderly, administering medications in a timely fashion, and assisting with elimination of urinary and fecal waste. The latter issue has seen many different approaches aimed at easing the difficulty of the task, where inadequacy in care may contribute to urinary and fecal incontinence, which has become prevalent in nursing home patients.

The difficulty of the task is directly related to the mobility and independence of the person involved. When a person maintains a sufficient amount of vigor, and of course is not a quadriplegic, they may contribute significantly in transporting themselves to use a standard toilet, perhaps requiring little or no assistance. As the individual grows increasingly infirm, such movement to and from a standard toilet will increasingly depend upon assistance by a caregiver, but may ultimately be limited depending on the size of the person needing assistance and the strength and agility of the caregiver.

The simple and immediate solution to that size/strength disparity, or to the reduced vigor of the user, is to provide a replacement for the standard lavatory toilet with some sort of a portable commode that may be located in close proximity to the user. This solution has seen the development of a variety of different commodes and/or bed pans.

One such solution is the stand-alone commode, as illustrated by U.S. Pat. No. 5,123,126 to Vincent. The patent discloses a modest-sized toilet seat over a bedpan that is mounted onto a walker frame with handrails, so that the user may independently make use of the rails to transport himself or herself to and from a bed to use the commode. The commode of U.S. Pat. No. 5,197,152 to Rose offers a comparable solution, but would appear to sacrifice the utility of the forward entry and hand rails of Vincent, for the greater comfort of a more conventional seat, which also inconveniently requires a posterior entry position—an entry position that would necessitate an unstable user having to rotate 180 degrees.

Both the invention of U.S. Pat. No. 5,123,126 and of U.S. Pat. No. 5,197,152 may successfully limit the distance that must be traveled by the infirm to the area immediately adjacent their bed, wheelchair, or other place of recuperation. However, this would only be available to those who still possess some ability to egress and ingress from their normal resting place. The traditional hospital or hospice approach has involved the use of small, portable, hand-held bed pans. While such portable bedpans have seen extensive use, both the portable and stand-alone bed pans or commodes mandate some level of assistance being provided by the care-giver, which is also a limitation upon the user as to when elimination may occur.

A greater level of independence from the assistance of the caregiver has been found with use of inventions such as that shown by U.S. Pat. No. 5,577,753 to Pociask. The Pociask invention relates to a wheelchair whose specially designed frame and wheels permits it to back up to and over a toilet, where the elongated seat has an opening that would be in-line vertically with the toilet bowl. The occupant may slide forward in the wheelchair seat over the seat opening to independently accommodate toilet needs. This approach provides increased freedom to those who are confined to a wheel chair throughout much of a day, while seeking to make use of conventional toilet facilities.

However, the Pociask approach still has several drawbacks. First, it is inherently a solution which is only available to those users who have the ability to use a wheel chair, and further still, for those who have been assisted into their wheelchair on a given day, as the solution requires access to a standard toilet. The requirement of access to a standard toilet in itself poses several problems or limitations. Where a toilet has a non-standard shape or installation, the Pociask wheelchair may not properly overlay about the toilet envelope. Moreover, where a wheelchair occupant resides at a place that has a conventional bathroom arrangement with sink, toilet and tub, there may be insufficient room to accommodate the increased wheel base of the wheelchair necessary to straddle the toilet, due to interference from the sink cabinet or tub periphery.

Another weakness of the Pociask approach is that it mandates that the user in his wheelchair remains in close proximity to the toilet facility. Many elderly, ill, and handicapped persons have little control over such bodily functions, so in order to be effective, they must not necessarily travel to distant areas of a nursing home or hospital, or even perhaps to a different floor of their residence, which may not have ready access to a toilet. As such, the Pociask invention does nothing to liberate the user from his hospital or convalescent room.

For those individuals who are far less mobile, the Vincent, the Rose, or even the Pociask inventions may still be utilized by transporting the incapacitated user to the commode or wheelchair through the use of a medical sling. While some insurance policies and even Medicare provide for the use of such devices, using a medical sling to lift an invalid from a bed or couch to a commode or the wheelchair of Pociask, still requires substantial caregiver assistance, and further aggravates the issue of timing due to the needs of the user.

The invention disclosed herein addresses all of these problems associated with the prior art, by providing a solution which is diverse in its applicability, such that it may be incorporated into an ordinary arm chair or couch, a bed, a wheel chair, or any other means occupied during convalescence or during an extended or permanent period of disability.

SUMMARY OF THE INVENTION

The comfort seat and commode device of this invention may be incorporated into some internal portion of a chair, a wheel chair, a bed, or any other apparatus, equipment or furnishing which may be used by persons who are convalescing from injury or illness, persons who have become infirm or an invalid as a result of advanced age, or persons who are handicapped as a result of disease or serious injury. The device provides a means by which such persons may urinate or defecate, under sanitary conditions, from the apparatus or furnishing in which they are constantly maintained or ordinarily occupy, without having to be conveniently near toilet facilities, and without the need of immediate assistance from a caregiver. The device provides a mechanical actuation system, which may be easily activated by the user, to provide access to an integral commode The comfort seat and commode device of this invention includes a framework that may take different forms in order to accommodate installation of the device into various apparatus or furnishings. The framework could form some simple geometric shape such as cylindrical shape, a trapezoidal shape, etc., or could be a custom designed complex geometric shape to correspond to the shape of the object into which the device is to be installed. In a preferred embodiment of the invention, the framework is generally in the form of a rectangular block-shape, where the frame base is composed of two base members and two transverse base members that generally form a square shape.

Vertical members extend from the junction of the base and transverse base members. The vertical junction members and the base and transverse base members are held together, in the preferred embodiment, by angle brackets that are mechanically fastened to each of the framework members. The vertical junction members terminate at the framework's top members and top transverse members, where such top and top transverse members also generally form a square shape. The vertical junction members are similarly attached to the top and top transverse members using angle brackets and mechanical fasteners.

The cross-section of the framework members could be any standard extruded geometric shape that is commercially available, and also could be any custom designed shape—formed or machined—to accommodate individual strength requirements or accommodate individual design considerations of the apparatus or furnishing into which the device is installed. In the preferred embodiment, a modified cruciform is utilized. The framework members may also be manufactured from a range of materials—metal, wood, plastic, etc., to satisfy strength and cost requirements.

The framework, in addition to accommodating installation of the device into various apparatus or furnishings, also supplies a means for affixing the comfort seat and the commode of the device, both of which necessarily must be more or less in-line vertically. The seat is located within and fixed to the rectangular shape of the top frame members, so as to protrude above the framework. This positioning permits the adjoining surface of the apparatus or furnishing, in which the device is incorporated, to be supported by the framework, and permits the adjoining surface to butt up against the seat of this device, to afford a comfortable and continuous surface upon which the user can sit or lie down.

The seat is pivotally mounted to the framework and held in place in the at-rest position, in the preferred embodiment, by an actuation means and a mechanism. The actuation means, upon command by the user, will cause the mechanism to drive the seat from the first, at-rest position to the second, in-use position, creating an opening through which elimination may occur. While it can be appreciated that many different kinds of actuators may be utilized for the actuation means, a rotary actuator was chosen for use in the preferred embodiment.

Mounted to the framework of the device, beneath the opening created by movement of the seat, is a commode comprised of a waste bin and cover. A separate actuation means is provided which, in the preferred embodiment, drives an arm that is attached to the cover, so as to open and close the cover, whose movement is synchronized with the movement of the seat. The cover is normally closed to inhibit odors from permeating the surrounding area, but the cover rotates so as to leave the waste bin opened when the seat is in the in-use position for the user to independently relieve himself or herself. The waste bin and waste bin cover arrangement may be attached to a post which incorporates a linear actuation means to raise the commode up into closer proximity to the opening in the apparatus or furnishing.

The device may also incorporate one or more rigid or flexible tanks or containers for storage of water and liquid soap which may, through use of a pump, tubing, a nozzle and the like, facilitate cleaning of the user through squirting action of such liquids. A blower, capable of delivering either warm or cool air, may also be provided to permit drying of the user after a cleaning operation.

DETAILED DESCRIPTION OF THE PREFERRED EMBODIMENT

Figure 1:
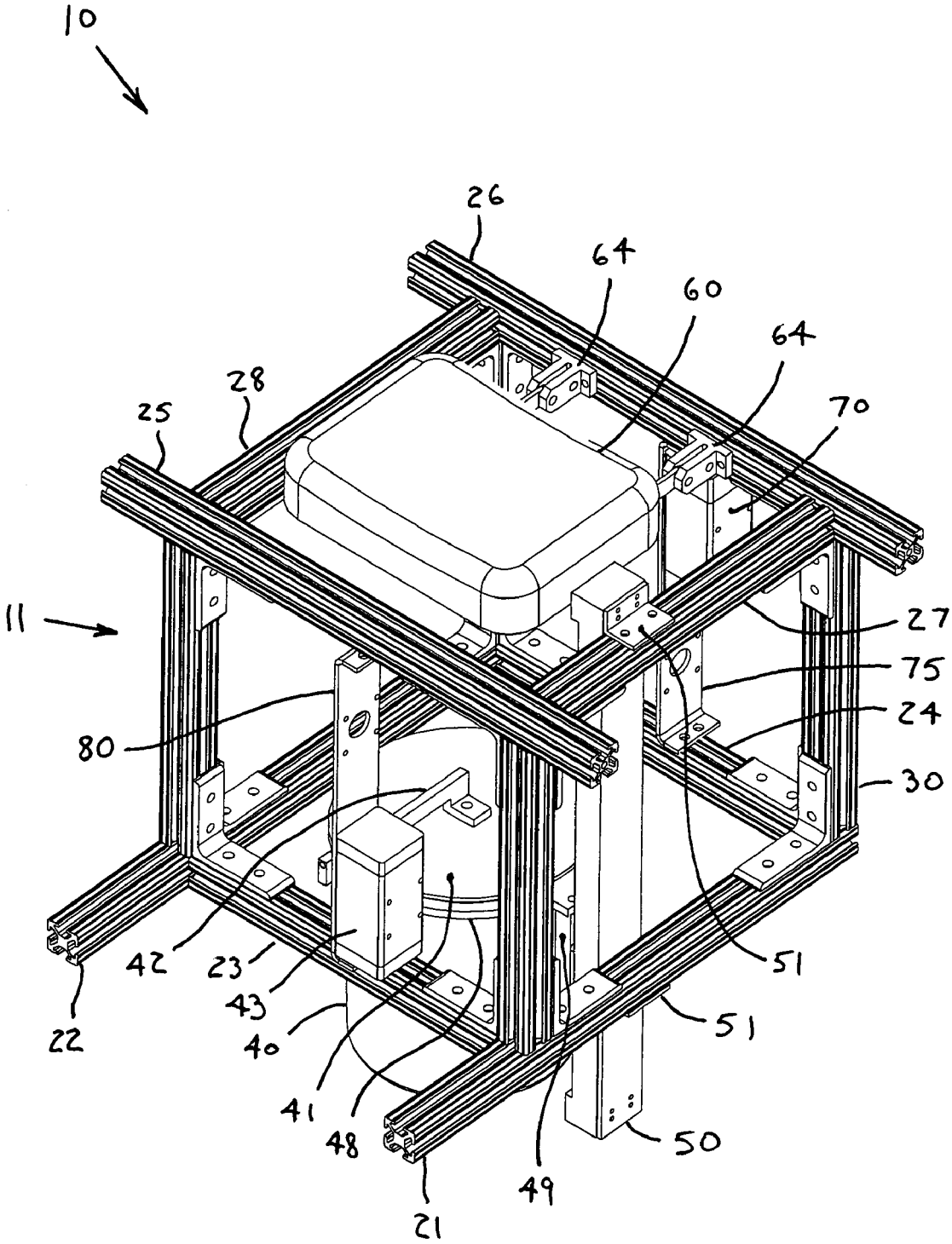
FIG. 1 is a perspective view of the Comfort Seat and Commode Device.

The Comfort Seat and Commode Device 10 of the present invention is shown in FIG. 1. The Device 10 includes a framework 11 (FIG. 6A), which may be constructed in many different shapes including, but not limited to a cylindrical shape, a trapezoidal-shaped block, an irregular shape, etc. A framework in the cylindrical form would permit its construction using a single, circular base member and a single circular top member separated by vertical members. However, in one embodiment, which is described in detail below, the framework 11 forms a rectangular block shape having a first Base Member 21 and a second Base Member 22, which are generally parallel and separated from each other by Transverse Base Members 23 and 24. The base members 21 and 22 may extend beyond the ends of Transverse Base Members 23 and 24, and furthermore, each may be modified not only in terms of length, but may also be broken into smaller members to accommodate particular installations. In a preferred embodiment, base members 21 and 22 extend beyond the Transverse Base Member 23, but do not extend beyond Transverse Base Member 24. It will be appreciated by those skilled in the art that many additions, deletions, and modifications to the framework may be made.

In the preferred embodiment, Vertical Junction Members 29, 30, 31, and 32 extend upward from base members 21 and 22 at the junction where Transverse Base Members 23 and 24 terminate at Base Members 21 and 22. The base members, transverse base members, and vertical junction members may be fixed to each other using a number different methods including, but not limited to, various brackets designs with mechanical fasteners, arc welding, electron beam welding, diffusion bonding, adhesive bonding, soldering or by brazing the members together. In the preferred embodiment, the base members, base transverse members, and vertical junction members are fixed to each other using a plurality of angle brackets 33. Angle Bracket 33 may have orifices 34 in each flange of the bracket, such that mechanical fasteners, including, but not limited to, screws, nuts and bolts, etc, may be used to fasten the bracket 33 to the respective ends of the base and transverse members 21, 22, 23, and 24 (FIGS. 1 and 6A), and connect them to the Vertical Junction Members 29, 30, 31, and 32.

Vertical Junction Members 29, 30, 31, and 32 terminate at Top Members 25 and 26, which may be generally parallel to Base Members 23 and 24, respectively. Transverse Top Members 27 and 28 are parallel to Base Members 21 and 22, and terminate at Top Members 25 and 26, where Vertical Junction Members 29, 30, 31, and 32 similarly terminate. The Top Members 25 and 26 may extend beyond the ends of Transverse Top Members 27 and 28. In the preferred embodiment, Top Members 25 and 26 extend beyond both Transverse Base Member 23, and Transverse Base Member 24. Angle Brackets 33 are used to mechanically fasten the top members 25 and 26 and transverse top members 27, and 28 to vertical junction members 29, 30, 31, and 32. It should be apparent that additional brackets, or linear or curved members, may be formed and utilized as necessary to accomplish installation of the comfort seat and commode device into the desired apparatus or furnishing.

Figure 6B:
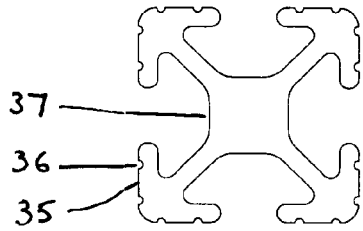
FIG. 6B is a view of the cross-section of the Framework Members of the Comfort Seat and Commode Device.
Figure 6A:
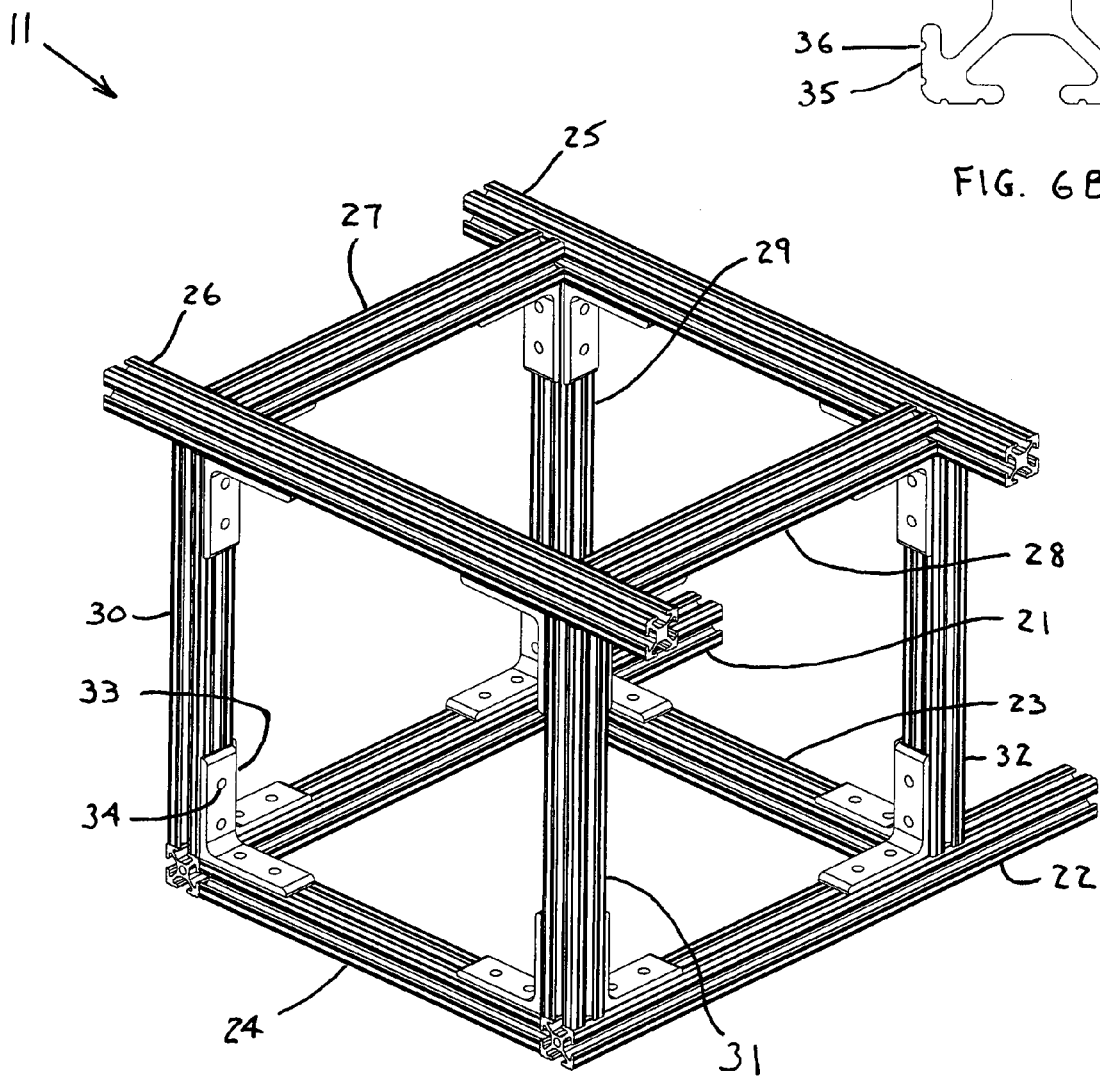
FIG. 6A is a perspective view of the Framework of the Comfort Seat and Commode Device.

The framework 11 members may utilize many different geometric cross-sectional shapes. The cross-section of the framework members could be a simple cross-sectional shape, such as those which are commonly utilized for extruded metal parts, including, but not limited to, a U-shaped cross-section, a "T" shape, an "H" shape, an "I" shape, an "L" shape, a rectangular shape, tubing, etc. It should be noted, however, that the framework members need not be an extruded part, and could be a machining, a forging, or a part formed using any other manufacturing process or some combination of these manufacturing processes. Although many different standard shapes are available, a custom designed geometric shape with greater complexity may be used for a particular application. In the preferred embodiment, a basic + shape or cruciform is used, where the cruciform has flanges 35 extending from the ends of each leg of the cruciform at roughly 45 degree angles, as shown in FIG. 6B. The members may also have grooves 36 running the length of the members, and may additionally have fillets 37 joining the legs of the cruciform to provide greater structural stability and strength.

Positioned just above the Top Members 25 and 26, and Transverse Top Members 27 and 28 is seat 60. Seat 60 is sized so as to provide minimal support while the user is resting upon the particular chair, bed, etc, in which the device is incorporated, but to be sufficiently large enough to create an opening through which the user may urinate or defecate, when the seat has been rotated from a first to a second position to create the opening. The opening would be created by the remaining surface area around the seat 60, which the user would primarily be resting upon (not shown) and which would be supported by Top Members 25 and 26, and Transverse Top Members 27 and 28, and would generally be flush to the edges of seat 60, as well as generally flush with the top of seat 60. Depending on the materials used for the comfort seat and the surrounding surface area of the apparatus or furnishing into which it is installed, a small gap between the comfort seat and surrounding area may be advantageous or even necessary.

Seat 60 is supported in the first position, or rest position, by a pair of Seat Mounting Brackets 61 which may be attached to the seat using orifices 69 in the bracket by utilizing mechanical fasteners, such as, but not limited to, bolts, screws, etc. Seat Mounting Brackets 61 have a lug end 62 which is pivotally attached to a pair of devises 64, where both devises may mount to a top framework member, and in the preferred embodiment, mount to Top Member 26. The seat 60 motion may be accomplished by an actuation means driving the seat 60 from the first "rest" position, to the second, "in use" position.

The actuation means could be one of many different actuator types, including linear actuators or rotary actuators, which could be hydraulically actuated, pneumatically driven, driven by an electric motor, and may be also in the form of a servo motor where the shaft is driven to specific angular positions based on the coded signal sent to the servo. Depending upon the apparatus or equipment into which the device is incorporated, power requirements may be satisfied by a battery or batteries, or through the use of alternating current.

In addition, depending on the actuation means selected, many different mechanical arrangements could be utilized. In the preferred embodiment, Rotary Actuator 70 has a shaft 71 to which is rigidly attached a first end of drive arm 68. Drive arm 68 may take many different forms, but in the preferred embodiment is an elongated rectangular bar. The second end of drive arm 68 is pivotally attached to a first end of connecting link 67. Connecting link 67 similarly could take many different forms, but in the preferred embodiment is also an elongated rectangular bar. The second end of connecting link 67 is pivotally mounted to the seat 60. Such pivotal mounting may be accomplished through many different configurations of brackets or even use of a clevis, but in the preferred embodiment, mounting brackets 61 are utilized and thus serve a dual purpose. Mounting brackets 61 in the preferred embodiment have orifices 63 to retain rod 66, which spans between the two brackets 61. Connecting link 67, in the preferred embodiment, is pivotally attached to rod 66, such that the rotary motion of the shaft 71 of actuator 70 causes rotation of drive link 68 whose motion is transmitted through connecting link 67 to drive seat 60, via the mounting brackets 61 and rod 66, to cause the seat 60 to rotate about the lug 62 and clevis 64 pivotal axis.

Figure 2:
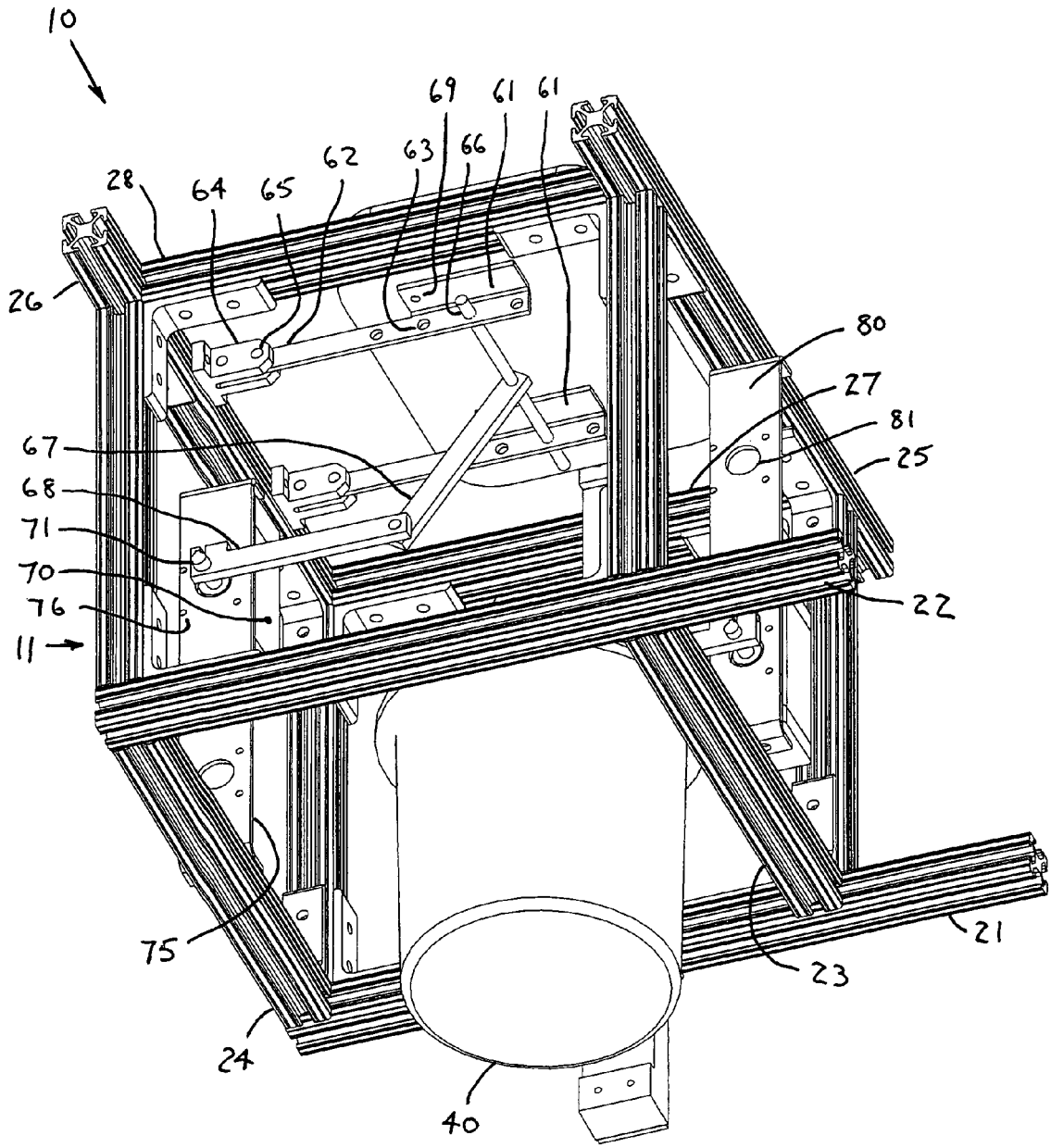
FIG. 2 is a perspective view of the Comfort Seat and Commode Device, looking up at the device.
Figure 3:
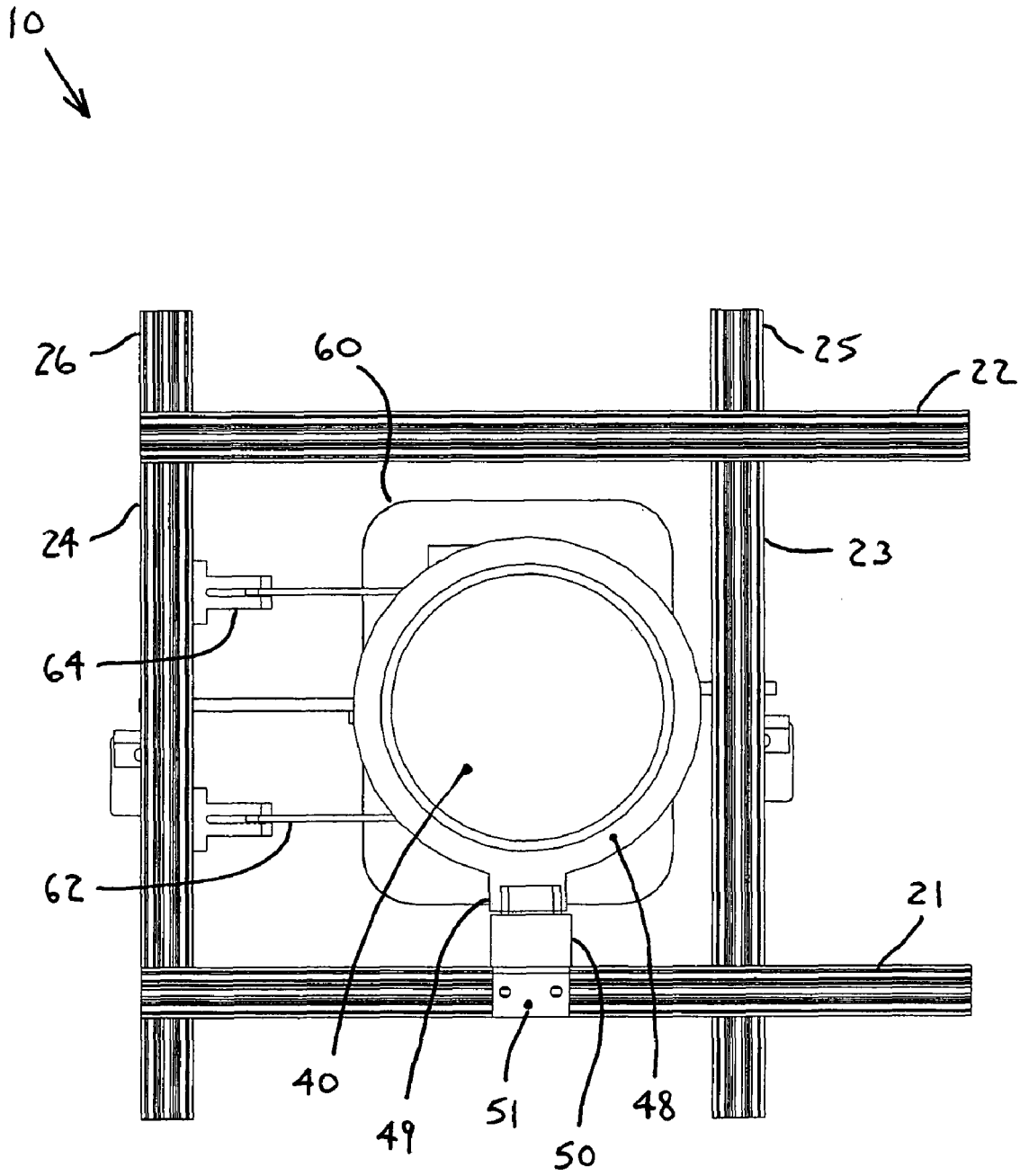
FIG. 3 is a bottom view of the Comfort Seat and Commode Device.

In the preferred embodiment, shown in FIG. 2, it can be seen that clockwise motion of the shaft 71 of rotary actuator 70 causes the seat 60 to rotate from the initial, at-rest position, to the in-use position. Conversely, counterclockwise motion of shaft 71 of rotary actuator 70 causes the seat 60 to rotate from the in-use position to the rest position.

The seat actuation means of this invention may be mounted using any number of custom bracket arrangements to suit the particular type of actuator chosen, as well as any variations arising from unique shapes or sizes of the actuator from a particular manufacturer. In the preferred embodiment, rotary actuator 70 is mounted to a support member 75, which spans between and attaches to top and base framework 11 members. Support member 75 may have orifices 76 to accommodate the shaft 71 and mounting pattern of actuator 70.

Figure 5A:
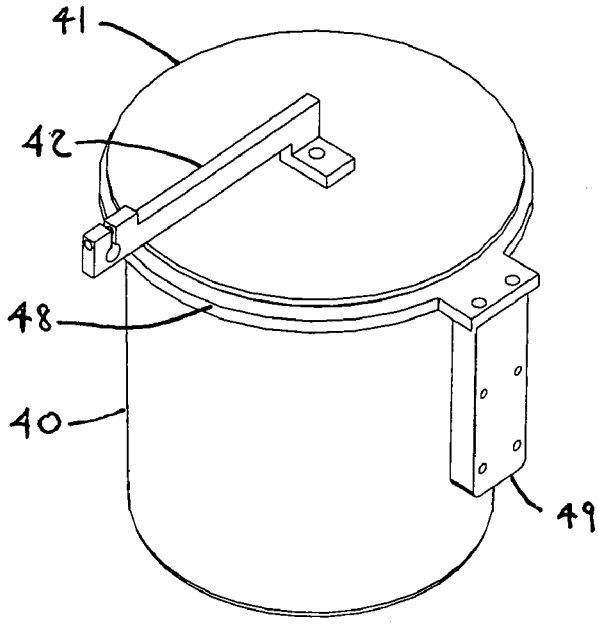
FIG. 5A is a perspective view of the Waste Bin, Waste Bin Cover, and other components comprising the Commode.
Figure 5B:
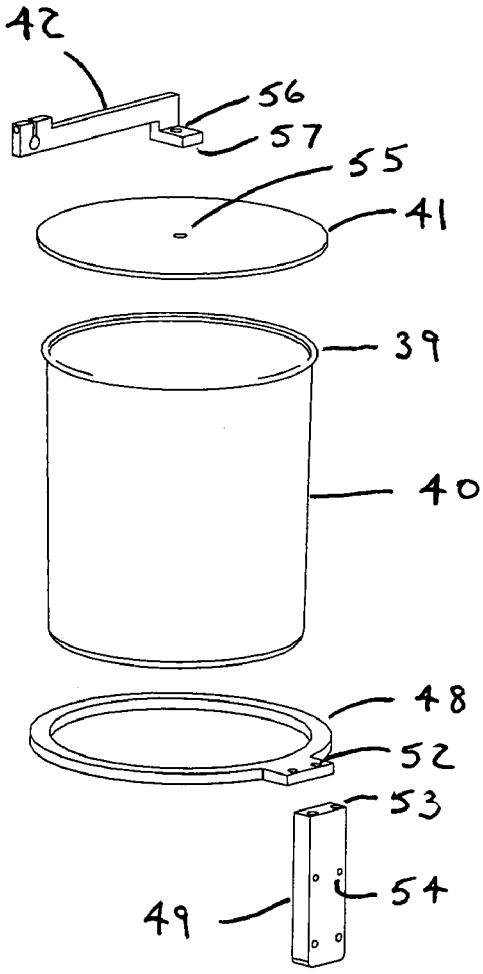
FIG. 5B is an exploded view of the components of the Commode.

To work in conjunction with seat 60 and accommodate elimination, a commode is provided in the form of waste bin 40 and Cover 41 (FIGS. 1 and 2). Waste bin 40 may be any shape to accommodate collection of waste, including, but not limited to a rectangular shape, a trapezoidal shape, a conical shape, a cylindrical shape, etc. In the preferred embodiment, a shape that is generally cylindrical was used. Waste bin 40 may be mounted to the framework 11 using any number of varying designs, but in the preferred embodiment, waste bin 40 has a lip 39 which permits the waste bin 40 to be inserted into Hoop 48 but to be retained by the hoop 48 as the lip 39 reaches the hoop (FIGS. 5A and 5B). Hoop 48 may have an integral flange for attachment to the framework 11, but in the preferred embodiment, hoop 48 has orifices 52 which are used to mechanically fasten the hoop to orifices 53 in mounting block 49. Mounting block 49 may also have a plurality of orifices 54 that are used to attach the block 49 to a generally vertical Support Member 50. Support member 50 is attached to the framework 11 using brackets 51.

Support member 50 may simply be a static means to achieve mounting of the waste bin of the commode, where the vertical length of support member 50 can be utilized to provide vertical adjustability of the waste bin. Where the support member 50 is utilized as a static means for supporting the waste bin 40 of the commode, it can be seen that a larger sized waste bin may be needed to successfully capture waste eliminated through the opening. However, in the preferred embodiment, support member 50 not only provides static support but also incorporates a linear actuation means so as to be capable of raising and lowering a smaller sized waste bin to be in closer proximity to the opening.

The waste bin 40 is not intended to normally be open, which would allow odors to propagate. A cover 41 is provided which normally would be in place over the bin, as seen in FIGS. 1 and 2. The cover 41 is intended to move from a first position to a second position, corresponding to the movement of the seat 60 from its rest position to its in-use position, when the user is seeking to eliminate. The motion of cover 41 may be accomplished through numerous different means, but in the preferred embodiment is accomplished in similar fashion as the seat 60, by using rotary actuator 43 to which the cover drive arm 42 may be rigidly attached. Drive arm 42 may have a flange 57 with orifice 56, which may be used to mechanically fasten the drive arm 42 to cover 41.

Figure 4:
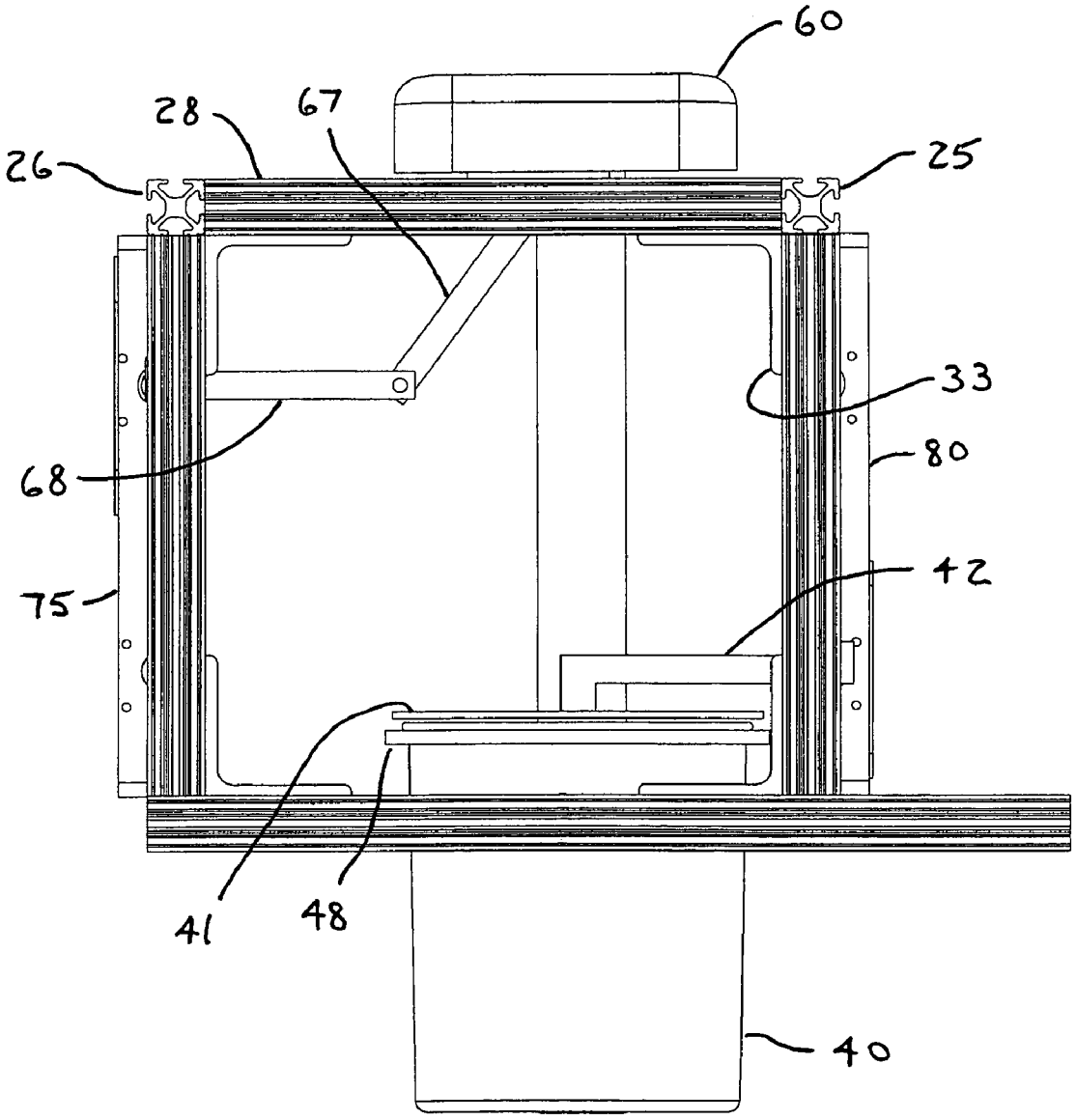
FIG. 4 a side is view of the Comfort Seat and Commode Device.

It can be seen that rotary movement of the shaft of rotary actuator 43 will cause rotation of arm 42, and direct rotation of cover 41. Although the mounting arrangement for the cover actuator 43 may also be accomplished through various different means, actuator 43 is mounted in a similar fashion as seat actuator 70—through use of actuator support member 80 which also spans between and attaches to top and base framework 11 members. Support member 80 may have orifices to accommodate the shaft and mounting pattern of the actuator 43. In fact, a mirrored set of orifices may be used on the actuator mounting bracket 80 such that one set could be used for mounting the cover actuator 43, whereby use of an additional support member 80, in place of the seat actuator support member 75, would permit mounting the seat actuator 70, reducing the number of necessary parts. Although this is not necessary and the seat and cover actuator member may be individually tailored, it can be seen in FIG. 4 that they could conveniently be the same part.

The framework 11 of the invention may also support a cleaning and drying system. The cleaning system may comprise a means for accommodating storage of water as well as soap. The storage may be in the form of a rigid tank or container, or a flexible bladder type storage means. The soap could be in any form, including liquid or powder form, and may even be in solid form with some means for accomplishing mixing appropriate parts of water and soap. Delivery of a cleaning solution may be accomplished through tubing and a pump to achieve squirting action, which cleans the user after elimination. Alternatively, delivery of the solution may be achieved directly from the storage means without use of tubing of any kind. The drying system may comprise any drying means capable of delivering either warm or cool air to the user. The system may be battery powered or may alternatively, where appropriate, be powered by standard household alternating current.

As previously stated, the Comfort Seat and Commode Device 10 may be tailored for installation into a range of apparatus, equipment, or furnishings, including, but not limited to, an ordinary arm chair or couch, a bed, a wheel chair, and generally any other means occupied during convalescence or during an extended or permanent period of disability. One possible installation of the Comfort Seat and Commode Device 10 is shown in FIGS. 7-13, where the device has been incorporated into one particular style of wheelchair. It will be appreciated that other types of wheelchairs or other devices may be used.

Figure 7:
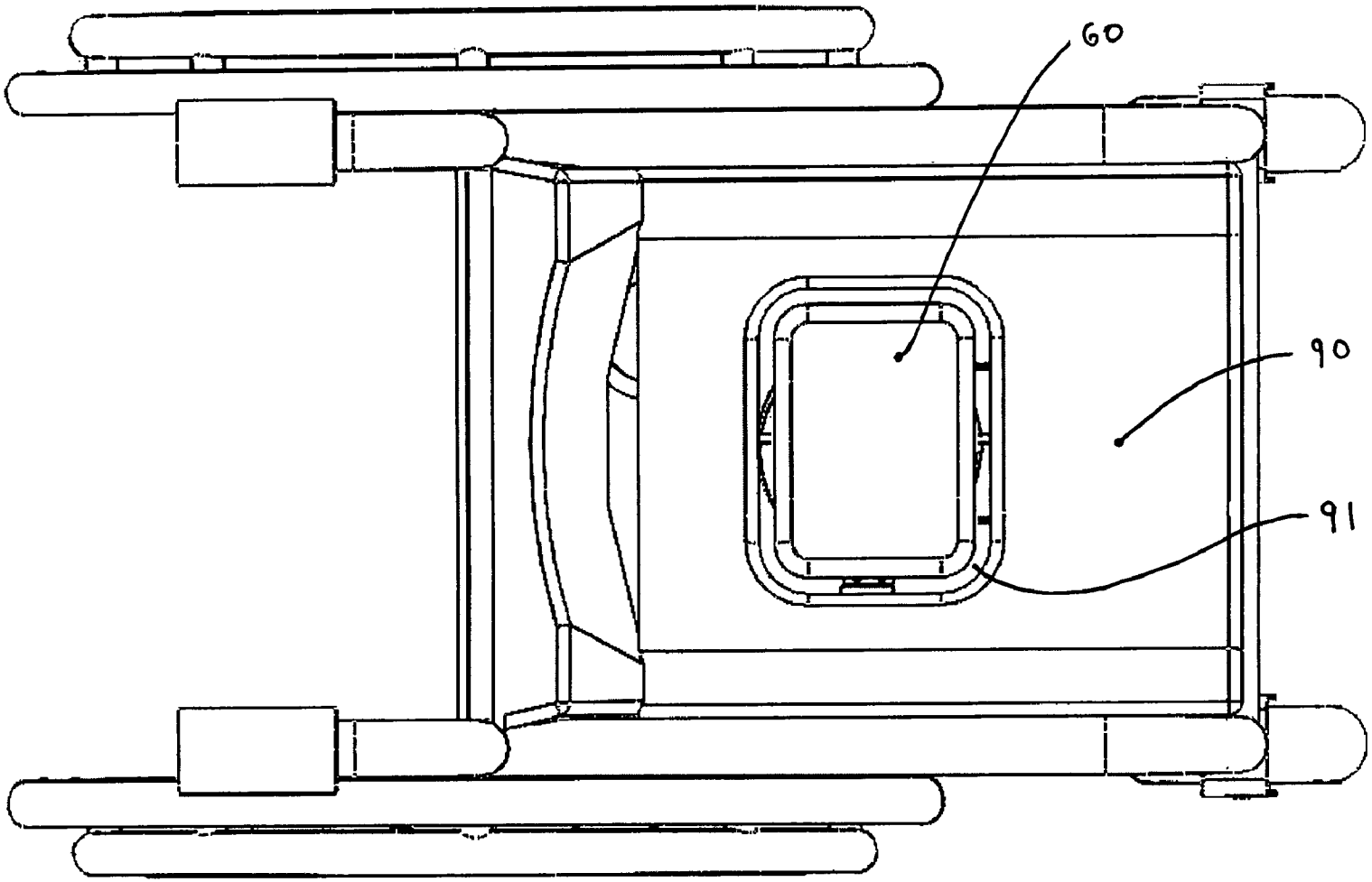
FIG. 7 is a top view of a wheelchair that has been fitted with the Comfort Seat and Commode device.
Figure 8:
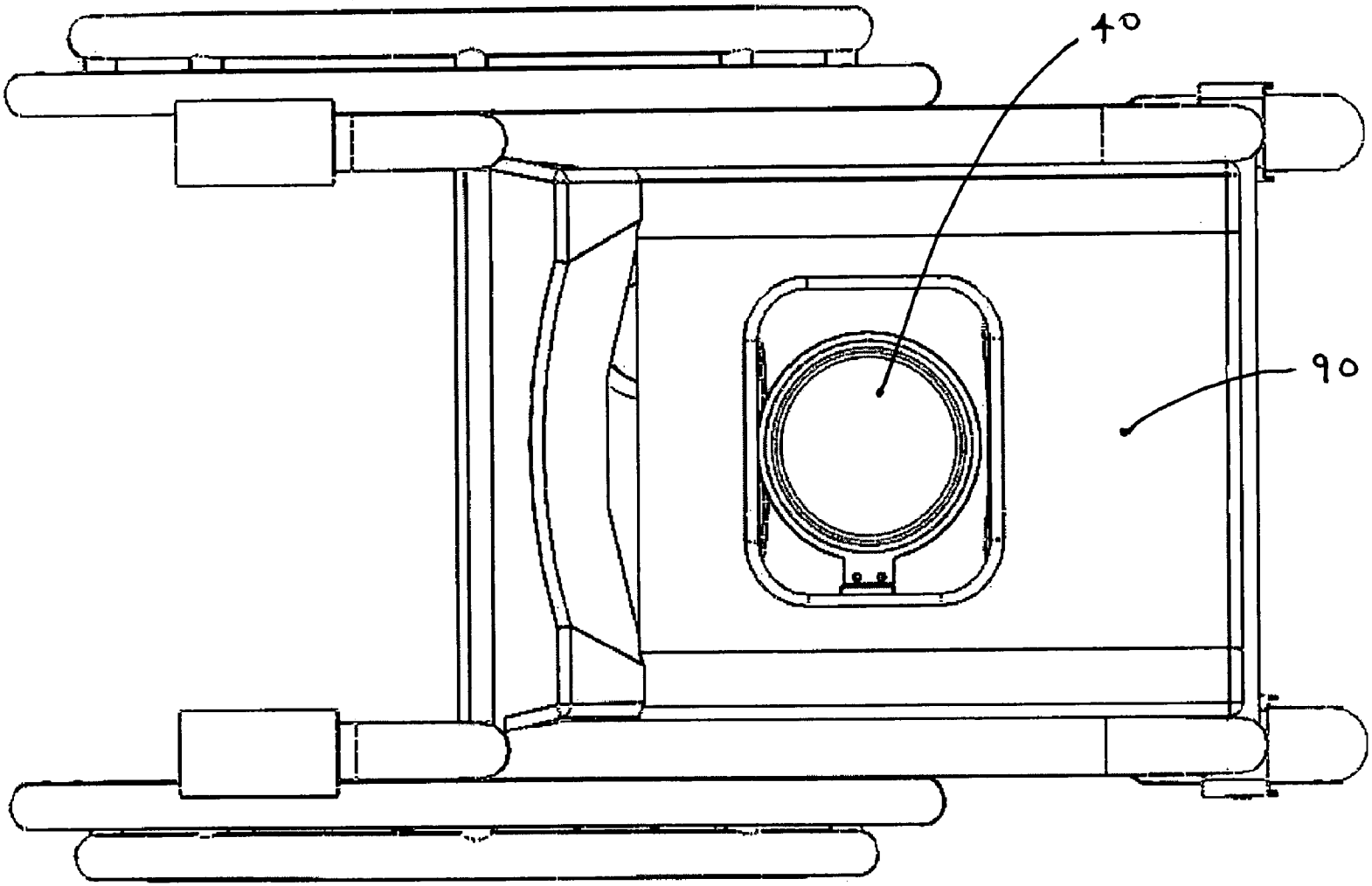
FIG. 8 is a top view of a wheelchair that has been fitted with the Comfort Seat and Commode device, with the comfort seat rotated to the in-use position.
Figure 9:
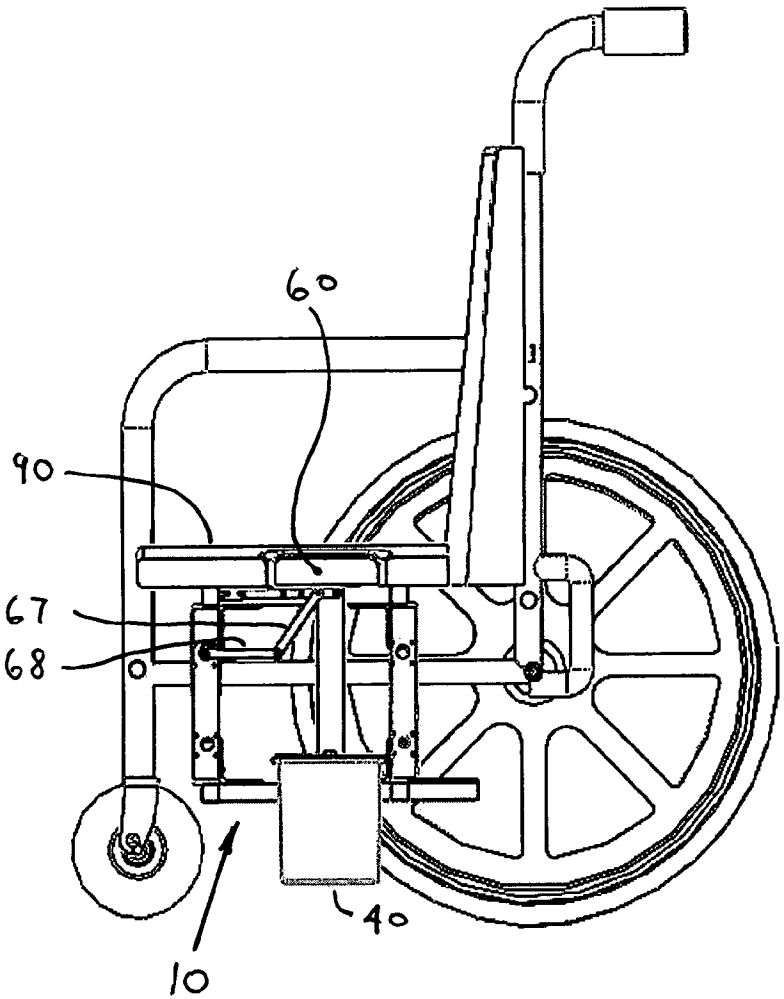
FIG. 9 is a side view of a wheelchair that has been fitted with the Comfort Seat and Commode device, with the device shown in the at-rest position.
Figure 10:
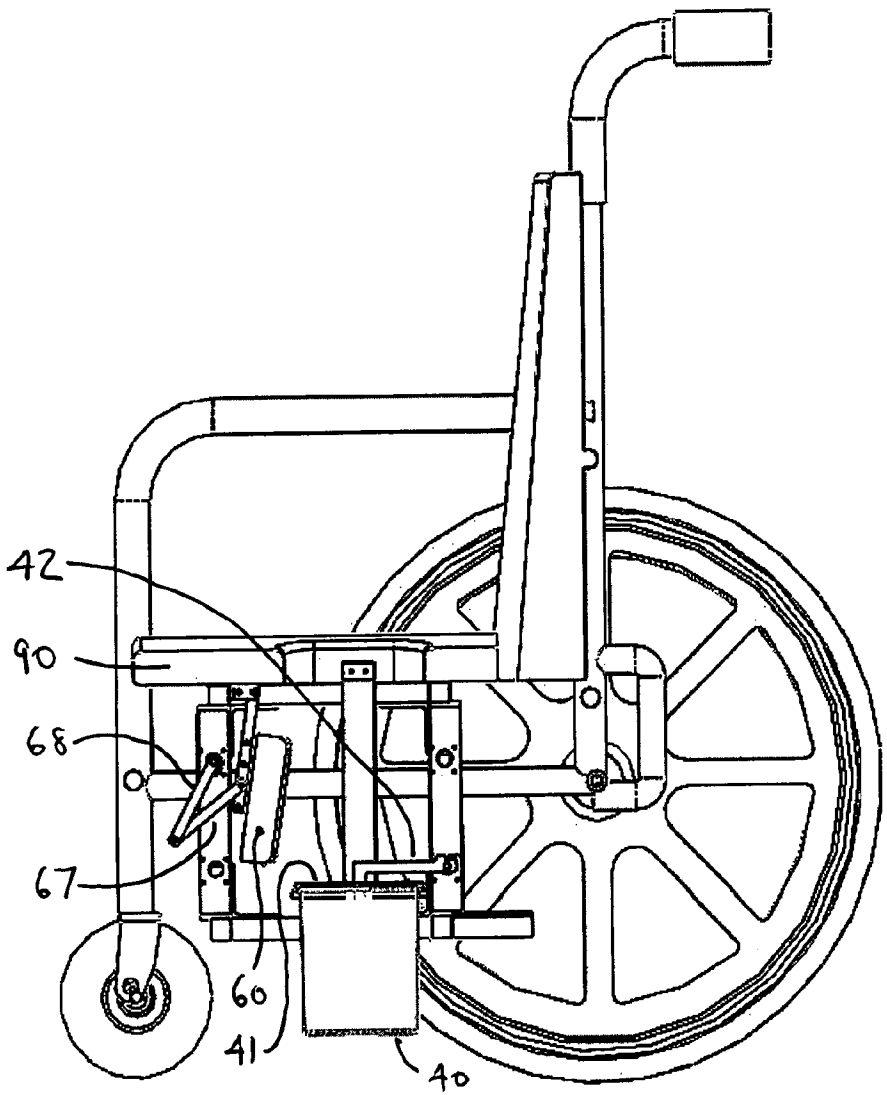
FIG. 10 is a side view of a wheelchair that has been fitted with the Comfort Seat and Commode device, shown with the comfort seat rotated to the in-use position.
Figure 11:
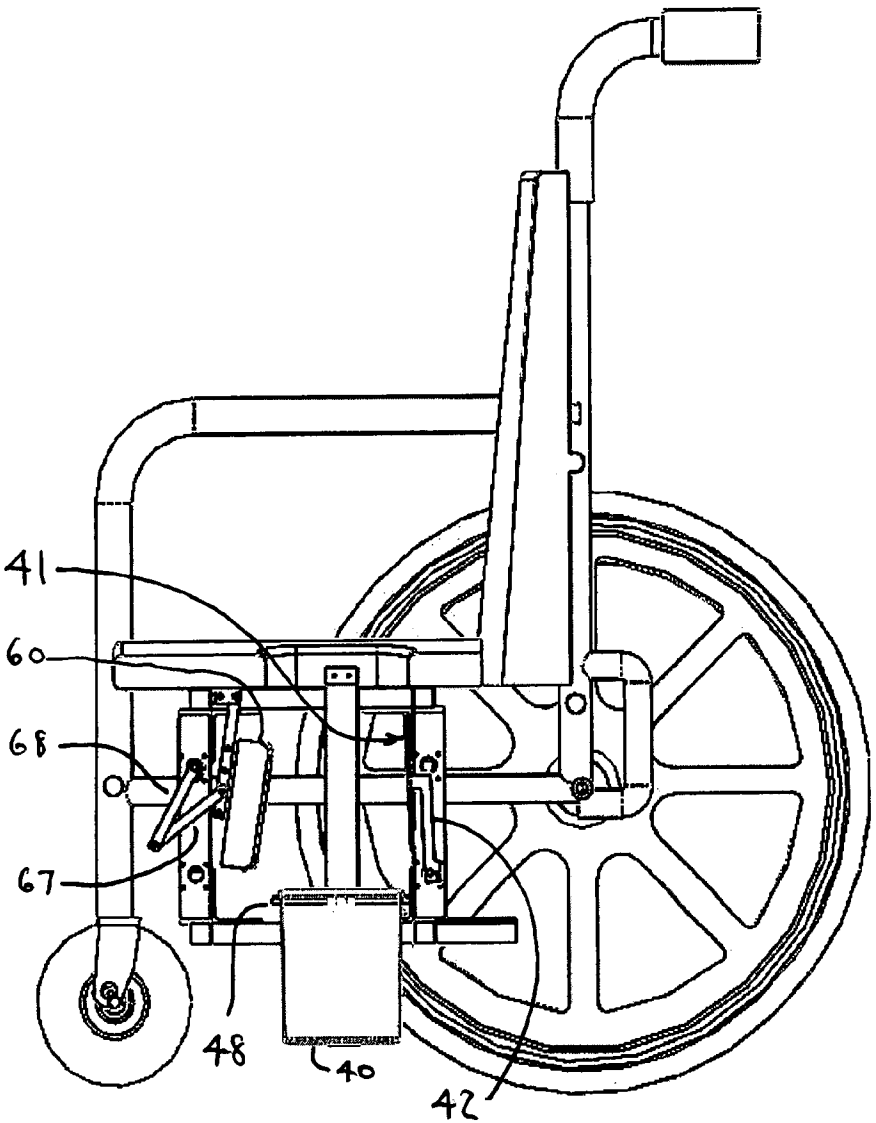
FIG. 11 is a side view of a wheelchair that has been fitted with the Comfort Seat and Commode device, shown with the comfort seat rotated to the in-use position, and the waste bin cover rotated to the in-use position.
Figure 12:
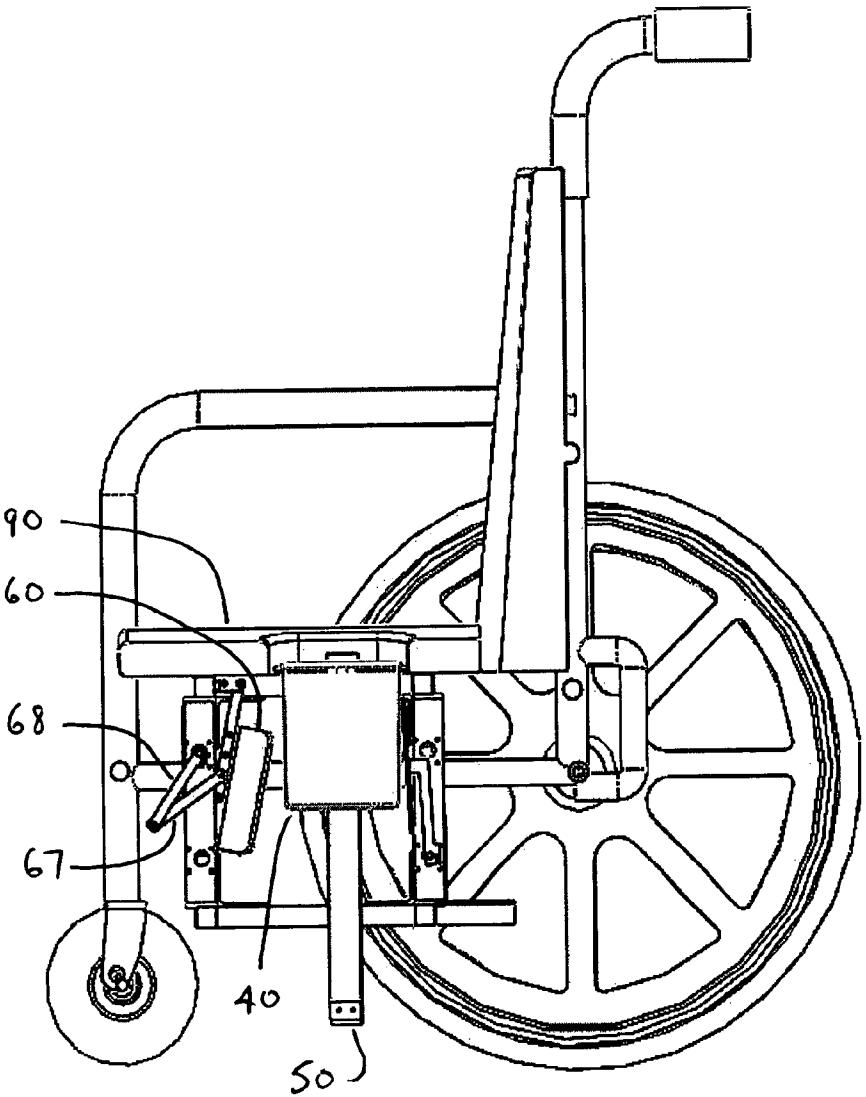
FIG. 12 is a side view of a wheelchair that has been fitted with the Comfort Seat and Commode device, shown with the comfort seat rotated to the in-use position, and waste bin cover rotated to the in-use position, and the waste bin elevated up to the opening of the wheelchair.
Figure 13:
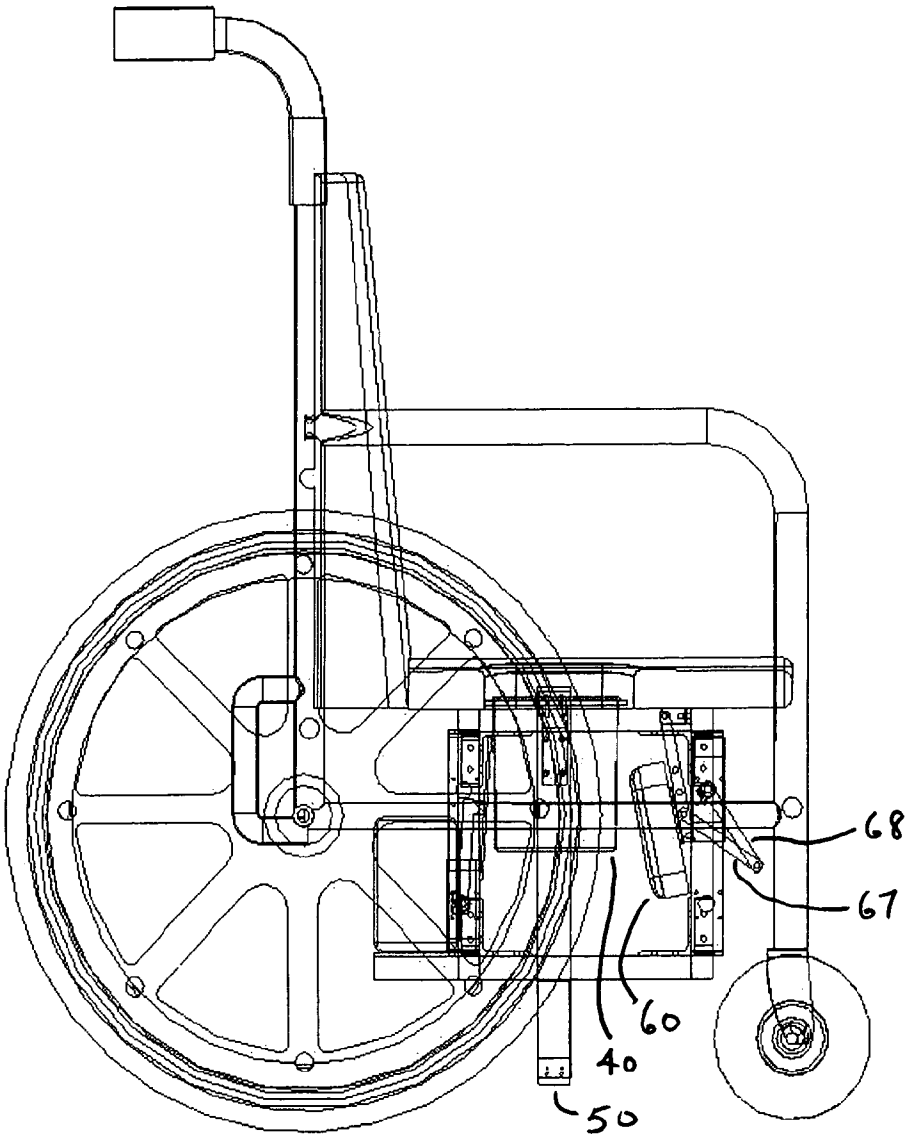
FIG. 13 is a transparent side view of a wheelchair that has been fitted with the Comfort Seat and Commode device, shown with the comfort seat rotated to the in-use position, the waste bin cover rotated to the in-use position, and the waste bin elevated up to the opening of the wheelchair.

FIG. 7 shows a top view of the chair with the comfort seat 60 and surrounding seat portion 90, with a gap 91 between the two. In FIG. 8, the comfort seat 60 has rotated into the in-use position to create the opening utilized for elimination, revealing the waste bin 40. FIGS. 9-12 are side views of the view chair showing the sequential positioning of the seat 60, waste bin cover 41, and waste bin 40. In FIG. 9, all of those components are in the rest position so the user may normally and comfortably occupy the wheel chair. FIG. 10 shows the seat 60 rotated to the in-use position. FIG. 11 shows the waste bin cover 41 rotated to the in-use position. FIG. 12 shows the waste bin translated to a position beneath the seat 90 of the wheel chair. Once the user has successfully completed urination or defecation, the components may be commanded to return to the rest positions for the user to normally occupy the wheelchair.

Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

We claim:

1. A Comfort Seat and Commode Device, for use in a chair, an arm chair, a wheel chair, a couch, a conventional bed, a hospital bed, or any other means of convalescence or permanent occupation by a disabled person, said device comprising:

(a) a framework;

(b) a seat portion, said seat portion having a top surface, a bottom surface, and at least one side surface; said seat portion comprising angle brackets, said angle brackets being pivotally attached to said framework using clevis brackets to permit pivotal movement of said seat portion from a first position to a second position; said top surface of said seat portion being positioned at a level to match the surrounding seat area of the object into which said device is incorporated;

(c) an actuation means capable of pivoting said seat portion, relative to said framework, from said first position to said second position, wherein said first position could be an open or a closed position, and said second position could be the other of said open or closed position;

(d) a waste bin wherein said waste bin is mounted to said framework;

(e) a waste bin cover wherein said waste bin cover is pivotally mounted to said framework;

(f) a cover actuation means capable of pivoting said waste bin cover from a first position to an second position.

2. The Comfort Seat and Commode Device of claim 1 wherein said framework comprises one or more base frame members, one or more top frame members, and one or more vertical members, said one or more vertical members having a first end connected to at least a portion of one of said base frame members and having a second end connected to at least a portion of one of said top frame members.

3. The Comfort Seat and Commode Device of claim 2 wherein said waste bin is mounted to said framework by suspending said waste bin using a mounting hoop attached to a support member, wherein said support member attaches to said framework.

4. A Comfort Seat and Commode Device, for use in a chair, an arm chair, a wheel chair, a couch, a conventional bed, a hospital bed, or any other means of convalescence or permanent occupation by a disabled person, said device comprising:

(a) a framework;

(b) a seat portion, said seat portion having a top surface, a bottom surface, and at least one side surface; said seat portion being pivotally attached to said framework; said top surface of said seat portion being positioned at a level to match the surrounding seat area of the object into which said device is incorporated;

(c) an actuation means capable of causing said seat portion to pivot relative to said framework, from a first position to a second position, wherein said first position could be an open or a closed position, and said second position could be the other of said open or closed position;

(d) a waste bin wherein said waste bin is mounted to said framework;

(e) a waste bin cover, said waste bin cover being pivotally mounted to said framework;

(f) a cover actuation means, said cover actuation means being capable of causing said waste bin cover to pivot from a first position to a second position, said cover actuation means comprising a rotary actuator; and wherein said rotary actuator drives an arm attached to said cover to cause said pivoting of said cover, said cover pivoting approximately 90 degrees between said first and second cover positions; said rotary actuator being mounted to a structural member of said framework that comprises a generally vertical structural member.

5. A Comfort Seat and Commode Device, for use in a chair, an arm chair, a wheel chair, a couch, a conventional bed, a hospital bed, or any other means of convalescence or permanent occupation by a disabled person, said device comprising:

(a) a framework;

(b) a seat portion, said seat portion having a top surface, a bottom surface, and at least one side surface; said seat portion comprising angle brackets, said angle brackets being pivotally attached to said framework using clevis brackets to permit pivotal movement of said seat portion from a first position to a second position; said top surface of said seat portion being positioned at a level to match the surrounding seat area of the object into which said device is incorporated;

(c) an actuation means capable of causing said seat to pivot relative to said framework, from said first position to said second position, wherein said first position could be an open or a closed position, and said second position could be the other of said open or closed position, and wherein said seat actuation means comprises an actuator and a mechanical arrangement, and wherein said actuator drives said mechanical arrangement;

(d) a waste bin wherein said waste bin is mounted to said framework;

(e) a waste bin cover wherein said waste bin cover is pivotally mounted to said framework;

(f) a cover actuation means capable of causing said waste bin cover to pivot from a first position to a second position.

6. The Comfort Seat and Commode Device of claim 5 wherein said framework comprises one or more base frame members, one or more top frame members, and one or more vertical members interconnecting said base frame member or members and said top frame member or members.

7. The Comfort Seat and Commode Device of claim 6 wherein the cross-sectional shape of said framework members is a complex cross-sectional shape.

8. The Comfort Seat and Commode Device of claim 7 wherein said framework members have a cross-section comprised of four legs in the shape of a cruciform.

9. The Comfort Seat and Commode Device of claim 8 wherein said legs of said cruciform shaped frame member have one or more flanges extending from an end of said leg.

10. The Comfort Seat and Commode Device of claim 9 wherein said mechanical arrangement comprises a drive arm having a first and a second end, and a connecting link having a first and a second end; said first end of said drive arm being rigidly attached to said actuator; and wherein said first end of said connecting link is pivotally connected to said second end of said drive arm, and said second end of said connecting link is pivotally connected to a rod, said rod being pivotally attached to said angle brackets of said seat portion.

11. The Comfort Seat and Commode Device of claim 10 wherein said seat actuator is a rotary actuator.

12. The Comfort Seat and Commode Device of claim 10 wherein said seat actuator is mounted to a member that connects to at least one top frame member and at least one base frame member.

13. The Comfort Seat and Commode Device of claim 10 wherein said seat portion rotates pivots approximately 90 degrees between said first and second positions.

14. The Comfort Seat and Commode Device of claim 10 wherein said seat portion pivots at least about 90 degrees between said first and second positions.

15. The Comfort Seat and Commode Device of claim 5 wherein said Waste bin is generally in-line with said seat portion.

16. The Comfort Seat and Commode Device of claim 15 wherein said waste bin is mounted to said framework by suspending said waste bin using a mounting hoop attached to a support member, wherein said support member attaches to said framework.

17. The Comfort Seat and Commode Device of claim 16 wherein said support member comprises a linear actuation means to move said waste bin, relative to said framework, from a first position to a second position.

18. The Comfort Seat and Commode Device of claim 5 wherein said cover actuation means comprises an actuator and a drive arm; said drive arm having a first end and a second end, said first end of said drive arm being fixed to said cover, and said second end being fixed to said actuator, said actuator being capable of pivoting said cover between said first and said second cover positions.

19. The Comfort Seat and Commode Device of claim 18 wherein said cover actuator is a rotary actuator.

20. The Comfort Seat and Commode Device of claim 19 wherein said rotary actuator is mounted to a structural member of said framework.

21. The Comfort Seat and Commode Device of claim 20 wherein said cover pivots approximately 90 degrees.

* * * * *